US008446318B2

(12) United States Patent
Ali et al.

(10) Patent No.: US 8,446,318 B2
(45) Date of Patent: May 21, 2013

(54) CONTROLLING A BEAMFORMING ANTENNA USING RECONFIGURABLE PARASITIC ELEMENTS

(76) Inventors: Shirook Ali, Milton (CA); James Warden, Fort Worth, TX (US)

( * ) Notice: Subject to any disclaimer, the term of this patent is extended or adjusted under 35 U.S.C. 154(b) by 221 days.

(21) Appl. No.: 12/820,902

(22) Filed: Jun. 22, 2010

(65) Prior Publication Data

US 2011/0309980 A1 Dec. 22, 2011

(51) Int. Cl.
*H01Q 3/00* (2006.01)

(52) U.S. Cl.
USPC ..... 342/383; 342/374

(58) Field of Classification Search
USPC ..... 342/368–377, 383, 367; 343/833, 343/844, 861
See application file for complete search history.

(56) References Cited

U.S. PATENT DOCUMENTS

| | | | | |
|---|---|---|---|---|
| 6,492,942 | B1 | 12/2002 | Kezys | |
| 6,657,595 | B1 * | 12/2003 | Phillips et al. | 343/702 |
| 6,917,338 | B2 * | 7/2005 | Bergervoet et al. | 343/702 |
| 7,057,573 | B2 | 6/2006 | Ohira | |
| 7,132,989 | B1 * | 11/2006 | Poilasne | 343/745 |
| 7,180,464 | B2 | 2/2007 | Chiang et al. | |
| 7,872,574 | B2 | 1/2011 | Betts et al. | |
| 2003/0030594 | A1 | 2/2003 | Larry | |
| 2003/0210203 | A1 | 11/2003 | Phillips | |
| 2005/0088358 | A1 | 4/2005 | Larry et al. | |
| 2009/0066440 | A1 | 3/2009 | Chan Wai Po et al. | |
| 2010/0302106 | A1 * | 12/2010 | Knudsen et al. | 343/702 |

FOREIGN PATENT DOCUMENTS

EP 1804335 A1 7/2007

OTHER PUBLICATIONS

Extended European Search Report for EP Application No. 10191977.7, dated Mar. 23, 2011.
Kuwahara, Y. et al., Trial Model of Adaptive Antenna Equipped with Switched Loads on Parasitic Elements, IEEE Transactions on Antennas and Propagation, IEEE Service Center, Piscataway, NJ, vol. 53, No. 10, Oct. 1, 2005.
International Search Report and Written Opinion for PCT Application No. PCT/US2011/041199, dated Oct. 20, 2011.

* cited by examiner

*Primary Examiner* — Cassie Galt
(74) *Attorney, Agent, or Firm* — Novak Druce Connolly Bove + Quigg LLP

(57) ABSTRACT

Methods, devices, and systems for controlling a beamforming antenna with reconfigurable parasitic elements is provided. In one embodiment, a method of controlling a beamforming antenna in a wireless device comprises calculating the input impedance of the beamforming antenna using an adaptive matching network, wherein said beamforming antenna includes a primary radiating element and one or more reconfigurable parasitic elements, and said primary radiating element and said reconfigurable parasitic elements cooperatively receive, transmit, or both a radio frequency signal; determining the input impedance of the beamforming antenna is outside a tolerance; recognizing the environment of the wireless device; selecting a portion of said reconfigurable parasitic elements using the input impedance of the beamforming antenna, a predetermined input impedance observation table, said recognized environment, or any combination thereof; and updating the beamforming antenna by electrically connecting, electrically coupling, or both said selected portion of said reconfigurable parasitic elements to said primary radiating element.

24 Claims, 11 Drawing Sheets

1100

CONTROLLING A BEAMFORMING ANTENNA USING RECONFIGURABLE PARASITIC ELEMENTS

CROSS-REFERENCE TO RELATED APPLICATIONS

There are no related applications.

FIELD

The invention generally relates to antennas and, in particular, to controlling a beamforming antenna using reconfigurable parasitic elements.

BACKGROUND

Wireless communication systems are widely deployed to provide, for example, a broad range of voice and data-related services. Typical wireless communication systems consist of multiple-access communication networks that allow users of wireless devices to share common network resources. These networks typically require multiple-band antennas for transmitting and receiving radio frequency ("RF") signals from wireless devices to infrastructure equipment such as a base station. Examples of such networks are the global system for mobile communication ("GSM"), which operates between 890 MHz and 960 MHz; the digital communications system ("DCS"), which operates between 1,710 MHz and 1,880 MHz; the personal communication system ("PCS"), which operates between 1,850 MHz and 1,990 MHz; and the universal mobile telecommunications system ("UMTS"), which operates between 1,920 MHz and 2,170 MHz.

Emerging and future wireless communication systems may require wireless devices and infrastructure equipment to operate new modes of communication at different frequency bands to support, for instance, higher data rates, increased functionality and more users. Examples of these emerging systems are the single carrier frequency division multiple access ("SC-FDMA") system, the orthogonal frequency division multiple access ("OFDMA") system, and other like systems. An OFDMA system is supported by various technology standards such as evolved universal terrestrial radio access ("E-UTRA"), Wi-Fi, worldwide interoperability for microwave access ("WiMAX"), wireless broadband ("WiBro"), ultra mobile broadband ("UMB"), long-term evolution ("LTE"), and other similar standards.

Moreover, wireless devices and infrastructure equipment may provide additional functionality that requires using other wireless communication systems that operate at different frequency bands. Examples of these other systems are the wireless local area network ("WLAN") system, the IEEE 802.11b system and the Bluetooth system, which operate between 2,400 MHz and 2,484 MHz; the WLAN system, the IEEE 802.11a system and the HiperLAN system, which operate between 5,150 MHz and 5,350 MHz; the global positioning system ("GPS"), which operates at 1,575 MHz; and other like systems.

Many wireless communication systems in both government and industry require a broadband, low profile antenna. Such systems may require antennas that simultaneously support multiple frequency bands. Further, such systems may require dual polarization to support polarization diversity, polarization frequency re-use, or other similar polarization operation.

In addition, smart antennas such as beamforming antennas can be used to increase capacity, reduce co-channel and adjacent channel interference, improve range, reduce transmitted power, and mitigate multipath propagation effects in wireless communication systems. Smart antennas can direct electromagnetic RF energy in a preferred direction such as towards the antenna of a base station. A smart antenna is typically composed of multiple radiating elements that can be switched into certain configurations to shape and direct an antenna-pattern beam.

However, smart antennas can suffer from a number of limitations including performance degradation from environmental-related conditions. Such conditions can include the presence of a user or an object near the smart antenna; multipath propagation effects; the speed of the wireless device traveling through a network; and other similar effects. The impact of such environmental conditions can result in, for instance, dropped calls, increased transmit power levels, lower data rates, higher power consumption, and other similar effects. As such, it is desirable to have a smart antenna that can adapt to such environmental conditions.

BRIEF DESCRIPTION OF THE DRAWINGS

In order for this disclosure to be understood and put into practice by one having ordinary skill in the art, reference is now made to exemplary embodiments as illustrated by reference to the accompanying figures. Like reference numbers refer to identical or functionally similar elements throughout the accompanying figures. The figures along with the detailed description are incorporated and form part of the specification and serve to further illustrate exemplary embodiments and explain various principles and advantages, in accordance with this disclosure, where.

Figure 1:
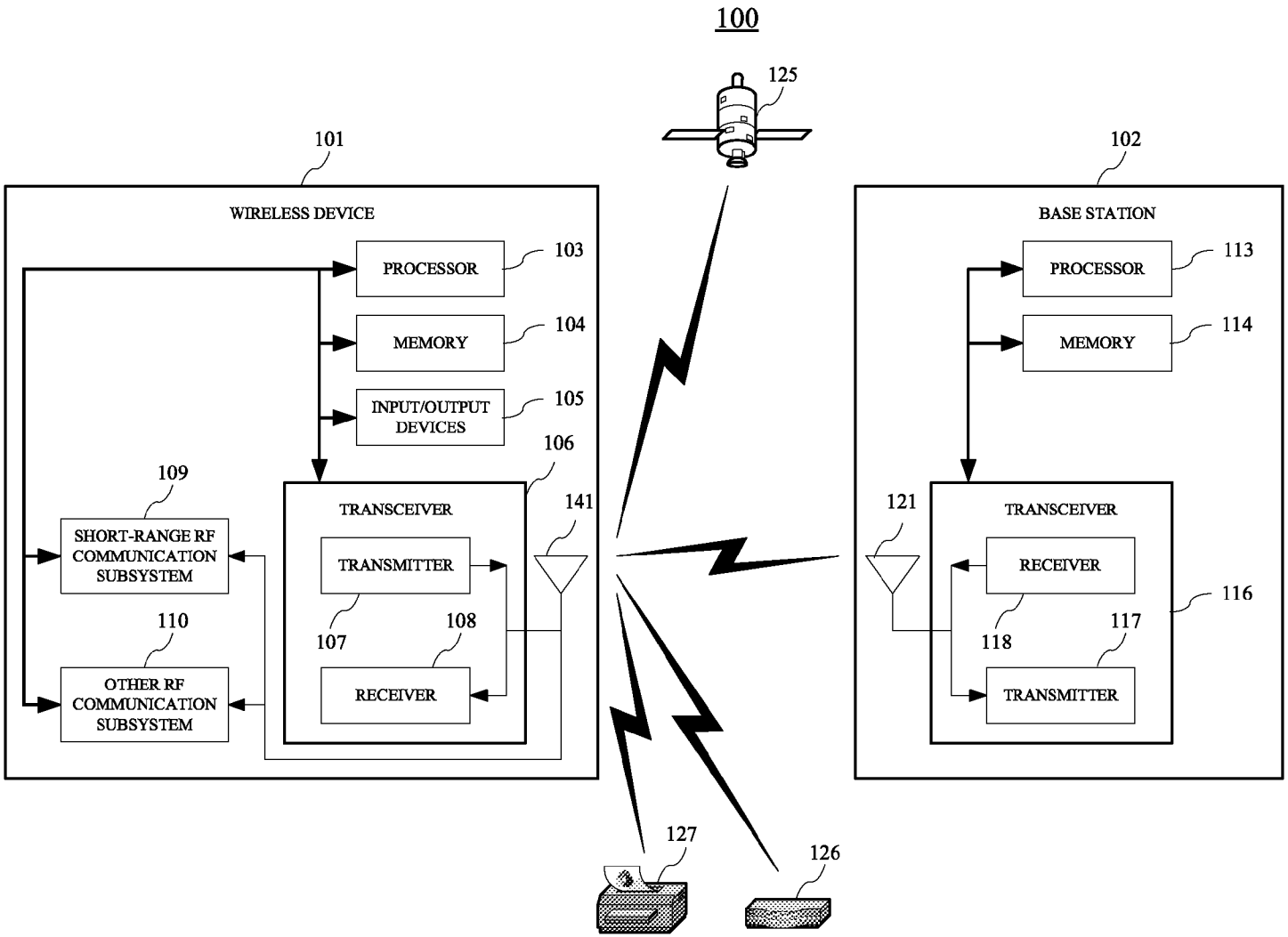
FIG. 1 (PRIOR ART)
FIG. 1 is an example of a wireless communication system.

Skilled artisans will appreciate that elements in the accompanying figures are illustrated for clarity, simplicity and to further help improve understanding of the exemplary embodiments, and have not necessarily been drawn to scale.

DETAILED DESCRIPTION

Although the following discloses exemplary methods, devices and systems for use in wireless communication systems, it will be understood by one of ordinary skill in the art that the teachings of this disclosure are in no way limited to the exemplary embodiments shown. On the contrary, it is contemplated that the teachings of this disclosure may be implemented in alternative configurations and environments. For example, although the exemplary methods, devices and systems described herein are described in conjunction with a configuration for aforementioned wireless communication systems, those of ordinary skill in the art will readily recognize that the exemplary methods, devices and systems may be used in other wireless communication systems and may be configured to correspond to such other systems as needed. Accordingly, while the following describes exemplary methods, devices and systems of use thereof, persons of ordinary skill in the art will appreciate that the disclosed exemplary embodiments are not the only way to implement such methods, devices and systems, and the drawings and descriptions should be regarded as illustrative in nature and not restrictive.

Various techniques described herein can be used for various wireless communication systems. The various aspects described herein are presented as methods, devices and systems that can include a number of components, elements, members, modules, peripherals, or the like. Further, these methods, devices and systems can include or not include additional components, elements, members, modules, peripherals, or the like. It is important to note that the terms "network" and "system" can be used interchangeably. Relational terms described herein such as "above" and "below", "left" and "right", "first" and "second", and the like may be used solely to distinguish one entity or action from another entity or action without necessarily requiring or implying any actual such relationship or order between such entities or actions. The term "or" is intended to mean an inclusive "or" rather than an exclusive "or." Further, the terms "a" and "an" are intended to mean one or more unless specified otherwise or clear from the context to be directed to a singular form. The term "electrical coupling" as described herein, which is also referred to as "capacitive coupling," "inductive coupling," or both, includes at least coupling via electric and magnetic fields, including over an electrically insulating area. The term "electrically connected" as described herein comprises at least by means of a conducting path, or through a capacitor, as distinguished from connected merely through electromagnetic induction.

Wireless communication systems typically consist of a plurality of wireless devices and a plurality of base stations. A base station can also be referred to as a node-B ("NodeB"), a base transceiver station ("BTS"), an access point ("AP"), a satellite, a router, or some other equivalent terminology. A base station typically contains one or more RF transmitters, RF receivers, or both electrically connected to one or more antennas to communicate with a wireless devices.

A wireless device used in a wireless communication system may also be referred to as a mobile station ("MS"), a terminal, a cellular phone, a cellular handset, a personal digital assistant ("PDA"), a smartphone, a handheld computer, a desktop computer, a laptop computer, a tablet computer, a printer, a set-top box, a television, a wireless appliance, or some other equivalent terminology. A wireless device may contain one or more RF transmitters, RF receivers or both electrically connected to one or more antennas to communicate with a base station. Further, a wireless device may be fixed or mobile and may have the ability to move through a wireless communication network.

FIG. 1 is a block diagram of a wireless communication system 100 in accordance with various aspects described herein. In one embodiment, the system 100 can include a wireless device 101, a base station 102, a satellite 125, an access point 126, another wireless device 127, or any combination thereof. The wireless device 101 can include a processor 103, which can also be referred to as a co-processor, controller, or other similar term, electrically connected to a memory 104, input/output devices 105, a transceiver 106, a short-range RF communication subsystem 109, another RF communication subsystem 110, or any combination thereof, which can be utilized by the wireless device 101 to implement various aspects described herein. The processor 103 can manage and control the overall operation of the wireless device 101. The transceiver 106 of the wireless device 101 can include a transmitter 107, a receiver 108, or both. Further, associated with the wireless device 101, the transmitter 107, the receiver 108, the short-range RF communication subsystem 109, the other RF communication subsystem 110, or any combination thereof can be electrically connected to an antenna 141.

In the current embodiment, the wireless device 101 can be capable of two-way voice communication, two-way data communication, or both including with the base station 102, the satellite 125, the access point 126, the other wireless device 127, or any combination thereof. The voice and data communications may be associated with the same or different networks using, for instance, the same or different base stations 102. The detailed design of the transceiver 106 of the wireless device 101 is dependent on the wireless communication system used. When the wireless device 101 is operating two-way data communication with the base station 102, a text message, for instance, can be received at the antenna 141, can be processed by the receiver 108 of the transceiver 106, and can be provided to the processor 103.

In FIG. 1, the short-range RF communication subsystem 109 may also be integrated in the wireless device 101. For example, the short-range RF communication subsystem 109 may include a Bluetooth module, a WLAN module, or both. The short-range RF communication subsystem 109 may use the antenna 141 for transmitting RF signals, receiving RF signals, or both. The Bluetooth module can use the antenna 141 to communicate, for instance, with the other wireless devices 127 such as a Bluetooth-capable printer. Further, the WLAN module may use the antenna 141 to communicate with the access point 126 such as a router or other similar device.

In addition, the other RF communication subsystem 110 may be integrated in wireless device 101. For example, the other RF communication subsystem 110 may include a GPS receiver that uses the antenna 141 of the wireless device 101 to receive information from one or more GPS satellites 125. Further, the other RF communication subsystem 110 may use the antenna 141 of the wireless device 101 for transmitting RF signals, receiving RF signals, or both.

Similarly, the base station 102 can include a processor 113 electrically connected to a memory 114 and a transceiver 116, which can be utilized by the base station 102 to implement various aspects described herein. The transceiver 116 of the base station 102 can include a transmitter 117, a receiver 118, or both. Further, associated with base station 102, a transmitter 117, a receiver 118, or both can be electrically connected to an antenna 121.

In FIG. 1, the base station 102 can communicate with the wireless device 101 on the uplink using the antennas 141 and 121, and on the downlink using the antennas 141 and 121, associated with the wireless device 101 and the base station 102, respectively. The uplink refers to communication from a wireless device to a base station, while the downlink refers to communication from a base station to a wireless device. In one embodiment, the base station 102 can originate downlink information using the transmitter 117 and the antenna 121, where it can be received by the receiver 108 at the wireless device 101 using the antenna 141. Such information can be related to a communication link between the base station 102 and the wireless device 101. Once such information is received by the wireless device 101 on the downlink, the wireless device 101 can process the received information to generate a response relating to the received information. Such response can be transmitted back from the wireless device 101 on the uplink using the transmitter 107 and the antenna 141, and received at the base station 102 using the antenna 121 and the receiver 118.

Figure 2:
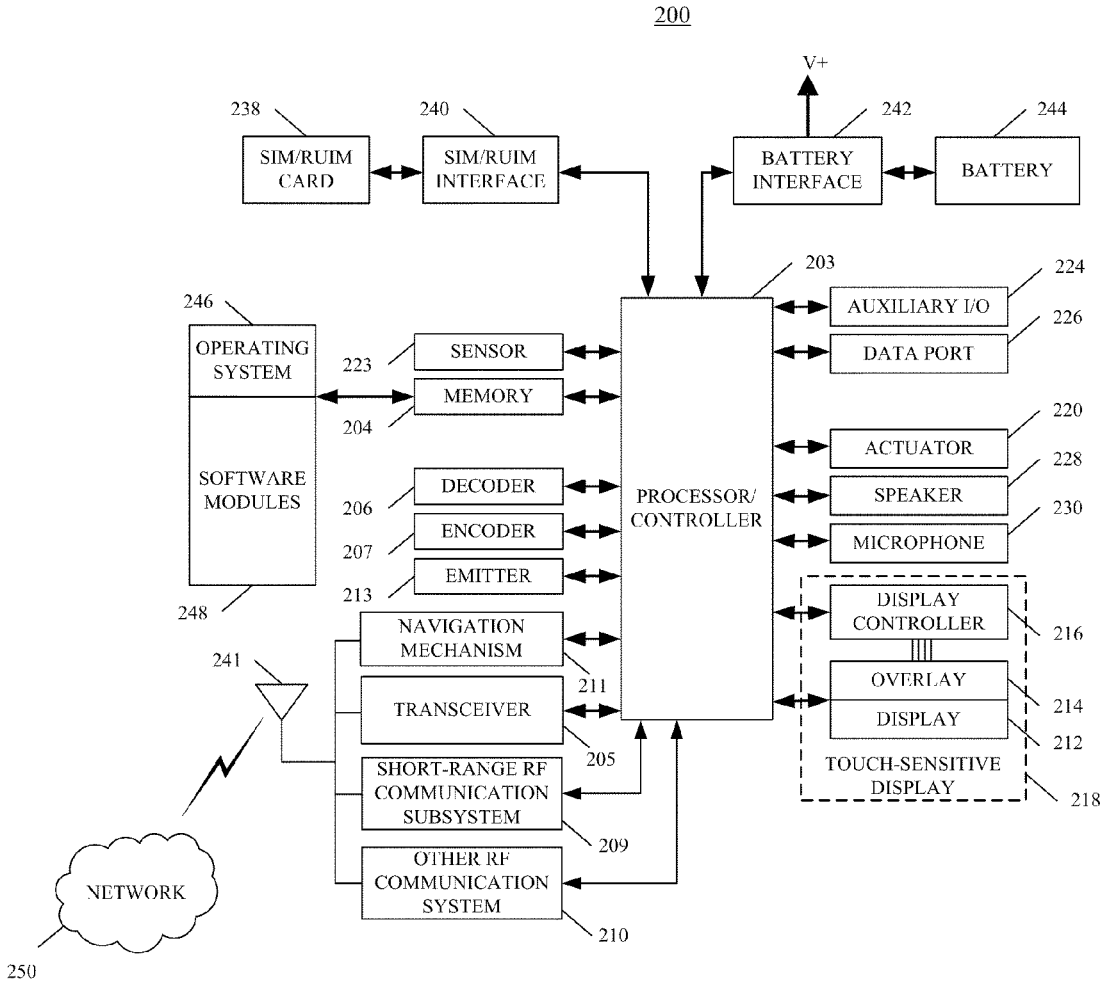
FIG. 2 is a block diagram illustrating one embodiment of a wireless device in accordance with various aspects set forth herein.

FIG. 2 is a block diagram illustrating one embodiment of a wireless device 200 in accordance with various aspects set forth herein. In FIG. 2, the wireless device 200 can include a processor 203 electrically connected to, for instance, a transceiver 205, a decoder 206, an encoder 207, a memory 204, a navigation mechanism 211, a display 212, an emitter 213, a display overlay 214, a display controller 216, a touch-sensitive display 218, an actuator 220, a sensor 223, an auxiliary input/output subsystem 224, a data port 226, a speaker 228, a microphone 230, a short-range communication subsystem 209, another RF communication subsystem 210, a subscriber identity module or a removable user identity module ("SIM/RUIM") interface 240, a battery interface 242, other component, or any combination thereof. The navigation mechanism 211 can be, for instance, a trackball, a directional pad, a trackpad, a touch-sensitive display, a scroll wheel, or other similar navigation mechanism.

In FIG. 2, the processor 203 can control and perform various functions associated with the control, operation, or both of the wireless device 200. The wireless device 200 can be powered by, for instance, the battery 244, an alternating current ("AC") source, another power source, or any combination thereof. In FIG. 2, the wireless device 200 can use, for instance, the battery interface 242 to receive power from the battery 244. The battery 244 can be, for instance, a rechargeable battery, a replaceable battery, or both. The processor 203 can control the battery 244 via the battery interface 242.

In this embodiment, the wireless device 200 can perform communication functions, including data communication, voice communication, video communication, other communication, or any combination thereof using, for instance, the processor 203 electrically connected to the auxiliary input/output subsystem 224, the data port 226, the transceiver 205, the short-range communication subsystem 209, the other RF communication subsystem 210, or any combination thereof. The wireless device 200 can communicate between, for instance, the network 250. The network 250 may be comprised of, for instance, a plurality of wireless devices and a plurality of infrastructure equipment.

In FIG. 2, the display controller 216 can be electrically connected to the display overlay 214, display 212, or both. For example, the display overlay 214 and the display 212 can be electrically connected to the display controller 216 to form, for instance, the touch-sensitive display 218. The touch-sensitive display 218 can also be referred to as a touch-screen display, touch-screen monitor, touch-screen terminal, or other similar term. The processor 203 can directly control display overlay 214, indirectly control display overlay 214 using display controller 216, or both. The processor 203 can display, for instance, an electronic document stored in the memory 210 on the display 212, the touch-sensitive display 218, or both of the wireless device 200.

In the current embodiment, the wireless device 200 can include the sensor 223, which can be electrically connected to the processor 203. The sensor 223 can be, for instance, an accelerometer sensor, a tilt sensor, a force sensor, an optical sensor, or any combination thereof. Further, the sensor 223 may comprise multiple sensors which are the same or different. For example, the sensor 223 can include an accelerometer sensor and an optical sensor. An accelerometer sensor may be used, for instance, to detect the direction of gravitational forces, gravity-induced reaction forces, or both. Further, the accelerometer sensor may be used to detect the placement of the wireless device 200 in various directional alignments such as a horizontal directional alignment. The accelerometer sensor may include, for instance, a cantilever beam with a proof mass and suitable deflection sensing circuitry. The optical sensor can be the same or similar to the sensor used in, for instance, a desktop mouse. Alternatively, the optical sensor can be, for instance, a camera lens. The processor 203 may be configured to process contiguous images captured by the camera lens and use such images to detect the direction, distance, or both of the wireless device 100 relative to an object, surface, or user. For instance, the processor 203 may be configured to process contiguous images captured by the camera lens and use such images to detect a user of the wireless device 200 placing such device, for instance, against the user's ear.

In FIG. 2, the wireless device 200 may include the subscriber identity module or a removable user identity module ("SIM/RUIM") card 238. The SIM/RUIM card 238 can contain, for instance, user identification information, which can be used to allow access to network 250 for the user of the wireless device 200. The SIM/RUIM card 238 can be electrically connected to the SIM/RUIM interface 240, wherein the processor 203 can control the SIM/RUIM card 238 via the SIM/RUIM interface 240. The user identification information may also be stored in the memory 204 and accessed by the processor 203.

In this embodiment, the wireless device 200 can include an operating system 246 and software modules 248, which may be stored in a computer-readable medium such as the memory 204. The memory 204 can be, for instance, RAM, static RAM ("SRAM"), dynamic RAM ("DRAM"), read only memory ("ROM"), volatile memory, non-volatile memory, cache memory, hard drive memory, virtual memory, other memory, or any combination thereof. The processor 203 can execute program instructions stored in the memory 204 associated with the operating system 246, the software modules 248, other program instructions, or combination of program instructions. The processor 203 may load the operating system 246, the software modules 248, data, an electronic document, or any combination thereof into the memory 204 via the transceiver 205, the auxiliary I/O subsystem 224, the data port 226, the short-range RF communications subsystem 209, the other RF communication subsystem 210, or any combination thereof.

Figure 3:
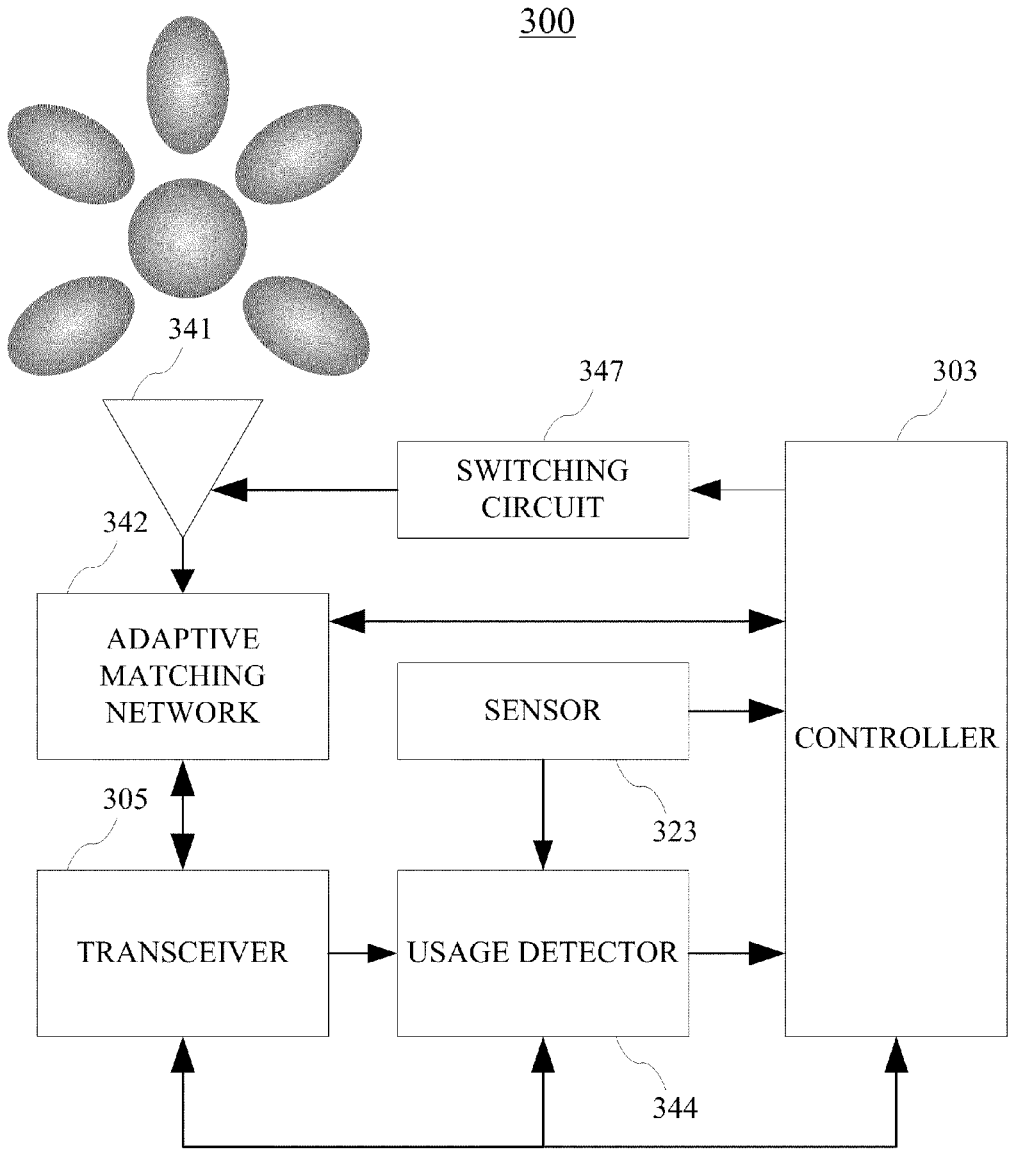
FIG. 3 illustrates a block diagram of one embodiment of a beamforming antenna system for a wireless device in accordance with various aspects set forth herein.

FIG. 3 illustrates a block diagram of one embodiment of a beamforming antenna system 300 for a wireless device in accordance with various aspects set forth herein. In FIG. 3, the system 300 can include a beamforming antenna 341, an adaptive matching network 342, a transceiver 305, a usage detector 344, a sensor 323, a controller 303, a switching circuit 347, other element, or any combination thereof. The beamforming antenna 341 can include a primary radiating element with one or more reconfigurable parasitic elements. The beamforming antenna 341 can shape and direct an electromagnetic antenna-pattern beam radiated from the beamforming antenna 341 to, for instance, improve the quality of a transmitted signal, received signal, or both. For example, the beamforming antenna 341 can adaptively steer the antenna-pattern beam towards a base station while traveling throughout the coverage area of such base station. Further, the beamforming antenna 341 can direct the antenna-pattern beam away from a user of the associated wireless device to reduce the amount of electromagnetic energy absorbed by such user. Also, by directing the antenna-pattern beam of the beamforming antenna 341 towards a receiving antenna such as at a base station can reduce the amount of co-channel or adjacent channel interference received by other wireless devices. By more effectively and efficiently receiving RF signals, radiating RF signals, or both, the wireless device using the beamforming antenna 341 can achieve better performance with lower average power consumption.

In FIG. 3, the steering of the antenna-pattern beam can be performed using, for instance, switching elements associated with the switching circuit 347 to select reconfigurable parasitic elements of the beamforming antenna 341. The selected parasitic elements and the primary radiating element can cooperatively receive and radiate RF signals. The beamforming antenna 341 can be electrically connected to the adaptive matching network 342, which can be used in, for instance, real time, near-real time, non-real time, periodically, aperiodically, or any combination thereof to match the input impedance of the beamforming antenna 341 to improve the power transfer and reduce reflections from the beamforming antenna 341. Further, the adaptive matching network 342 can be used in, for instance, real time, near-real time, non-real time, periodically, aperiodically, or any combination thereof to estimate the input impedance of the beamforming antenna 341. The transceiver 305 can include a transmitter, a receiver, or both. The input to the transceiver 305 can be an RF signal, which has been converted from an electromagnetic signal to an electrical signal via the beamforming antenna 341. The output of the transceiver 305 can be a baseband signal or an intermediate frequency ("IF") signal. On the downlink, the input to the transceiver 305 can be an RF signal, which can be converted from an electromagnetic signal to an electrical signal via the beamforming antenna 341. The output of the transceiver 305 can be a baseband signal or an intermediate frequency ("IF") signal. Similarly, on the uplink, the input to the transceiver 305 can be a baseband signal or an IF signal. The output of the transceiver 305 can be an RF signal, which can be converted from an electrical signal to an electromagnetic signal by the beamforming antenna 341. The detailed design of the transceiver 305 is dependent on, for instance, the wireless communication system used.

In the current embodiment, the usage detector 344 can be used to determine, for instance, the orientation, the operating mode, the operating environment, or any combination thereof of the wireless device, which may be used to determine to update the beamforming antenna 341, adapt the antenna-pattern beam of the beamforming antenna 341, or both. The usage detector 344 can receive, for instance, a signal from the adaptive matching network 342, a signal from the transceiver 305, a signal from the sensor 323, other signal, or any combination thereof. The usage detector 344 can determine the operating environment of the wireless device by identifying a change in, for instance, the received signal strength of the beamforming antenna 341; the directional alignment of the wireless device using, for instance, an accelerometer; the propagation characteristics of a received signal; the input impedance of the beamforming antenna 341; other information; or any combination thereof.

For instance, the usage detector 344 can determine that the wireless device is placed against a user's ear during a voice call using the call processing state of the wireless device, the directional alignment of the wireless device, a change in the input impedance of the beamforming antenna 341, other factor, or any combination thereof. For example, the usage detector 344 can receive a signal from the sensor 323 indicating that the wireless device is in a substantially horizontal directional alignment consistent with the positioning of the wireless device by a user during a voice call. Further, the controller 303 can provide the usage detector 344 with, for instance, the call processing state of the wireless device such as a voice call state. In addition, the usage detector 344 can monitor for a change in the input impedance of the beamforming antenna 341 using the adaptive matching network 342, which may be used to determine, for instance, that a wireless device is close to the user's body. After determining, for instance, that the wireless device is placed against a user's ear during a voice call, the controller 303 can switch one or more reconfigurable parasitic elements of the beamforming antenna 341 to steer the antenna-pattern beam away from the user's body.

In FIG. 3, the controller 303 can determine to update the antenna-pattern beam of the beamforming antenna 341 by using, for instance, a change in the received signal strength of the beamforming antenna 341, the directional alignment of the wireless device, the propagation characteristics of a received signal via the beamforming antenna 341, the input impedance of the beamforming antenna 341 using the adaptive matching network 342, or any combination thereof. In another embodiment, the controller 303 can measure a plurality of received signal strengths of the beamforming antenna 341, wherein each measurement can correspond to the primary radiating element with one or more different reconfigurable parasitic elements. Further, the controller 303 can determine to steer the beamforming antenna 341 by, for instance, comparing one or more of such received signal strengths to the received signal strength of the currently configured beamforming antenna.

Figure 4:
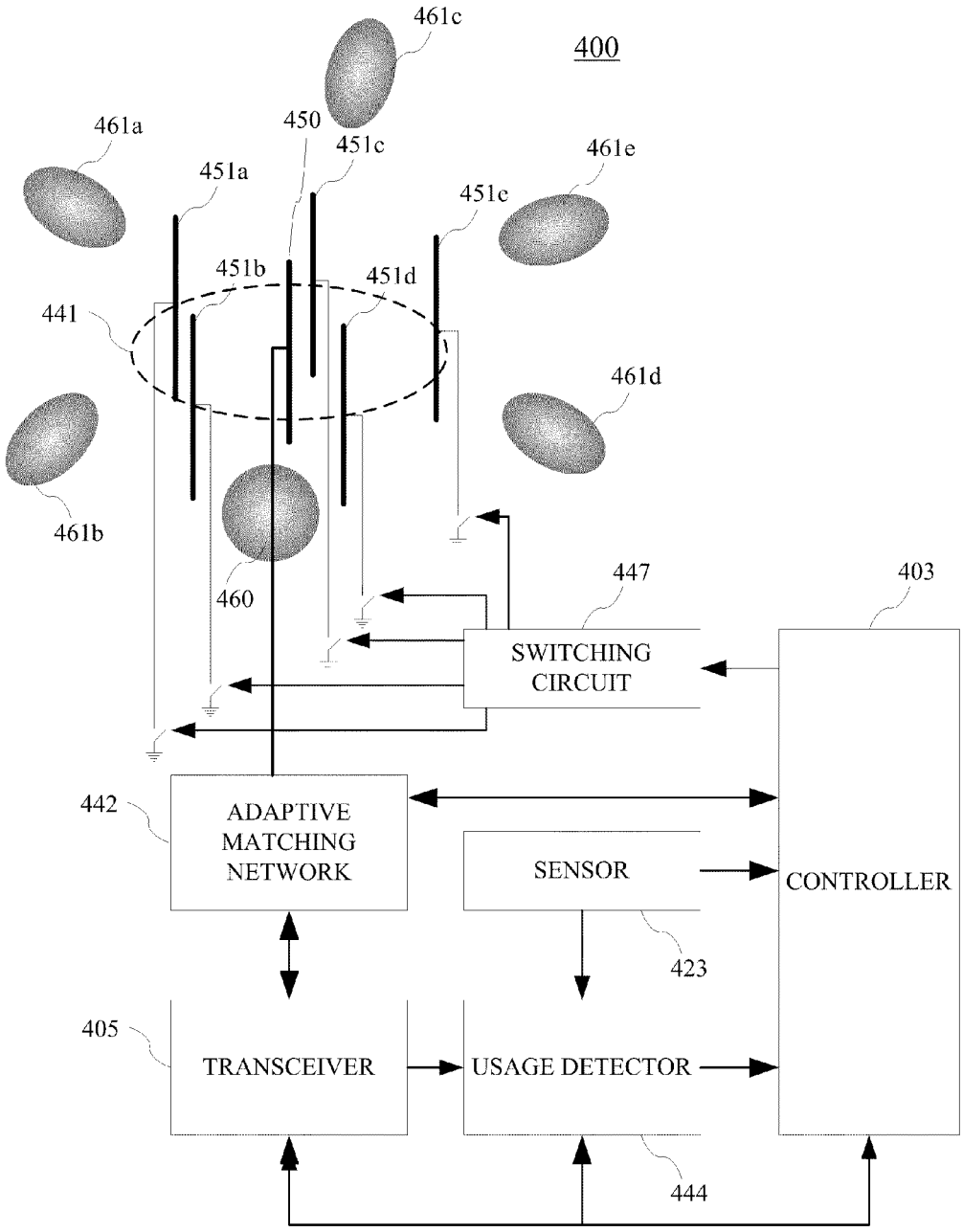
FIG. 4 illustrates a block diagram of another embodiment of a beamforming antenna system for a wireless device in accordance with various aspects set forth herein.

FIG. 4 illustrates a block diagram of another embodiment of a beamforming antenna system 400 for a wireless device in accordance with various aspects set forth herein. In FIG. 4, the system 400 can include a beamforming antenna 441, an adaptive matching network 442, a transceiver 405, a usage detector 444, a sensor 423, a controller 403, a switching circuit 447, other element, or any combination thereof. The beamforming antenna 441 can include a primary radiating element 450 with one or more secondary parasitic elements 451*a* to 451*e*. In this embodiment, the primary radiating element 450 is a dipole. Further, there are five reconfigurable parasitic elements, wherein each of the reconfigurable parasitic elements 451*a* to 451*e* is a dipole. In another embodiment, the primary radiating element and the reconfigurable parasitic elements are monopoles. It is important to recognize that the primary radiating element and any combination of the reconfigurable parasitic elements form a beamforming antenna, which can radiate with specific characteristics. Further, the primary radiating element and any combination of the reconfigurable parasitic elements can be electrically connected, electrically coupled, or both. Therefore, the primary radiating element and any combination of the reconfigurable parasitic elements can be physically connected or not physically connected.

In one definition, a dipole antenna, is an omnidirectional radio antenna with a center-fed driven element, which can be made of, for instance, a simple copper wire. Further, in one definition, a monopole antenna is an omnidirectional antenna formed by replacing one half of a dipole antenna with a ground plane at a substantially perpendicular angle to the monopole, wherein the monopole can behave like a dipole if the ground plane is sufficiently large. The length of a radiating element such as a monopole can typically be as short as about one-quarter the wavelength of the desired resonant frequency. One skilled in the art will appreciate that the length of a radiating element of the present disclosure is not limited to one-quarter the wavelength of the desired resonant frequency, but other lengths may be chosen, such as one-half the wavelength of the desired resonant frequency. Similarly, the length of a radiating element such as a dipole can typically be as short as about one-half the wavelength of the desired resonant frequency.

The beamforming antenna 441 can direct an electromagnetic antenna-pattern beam 461*a* to 461*e* radiated from the beamforming antenna 441 to improve the quality of a transmitted signal, received signal, or both. The beamforming antenna 441 can adaptively steer the antenna-pattern beam 461*a* to 461*e* towards, for instance, a base station while traveling throughout the coverage area of the base station. For example, the controller 403 selects the parasitic element 451*a*. In such configuration, the primary radiating element 450 and the parasitic element 451*a* cooperatively transmit an antenna-pattern beam in the direction consistent with the antenna-pattern beam 461*a*. In another example, the controller 403 does not select any reconfigurable parasitic elements 451*a* to 451*e*. In such configuration, the primary radiating element 450 provides an omnidirectional beam. In another example, the controller 403 selects the reconfigurable parasitic elements 451*a* and 451*b*. In such configuration, the primary radiating element 450 and the reconfigurable parasitic elements 451*a* and 451*b* provide an antenna-pattern beam in the direction between the antenna-pattern beams 461*a* and 461*b*. Further, the beamforming antenna 441 can direct the antenna-pattern beam 461*a* to 461*e* away from a user of the associated wireless device to reduce the amount of electromagnetic energy absorbed by such user. Also, by directing the antenna-pattern beam 461*a* to 461*e* of the beamforming antenna 441 towards a receiving antenna such as at a base station can reduce the amount of interference received by other wireless devices. By more effectively and efficiently receiving RF signals, radiating RF signals, or both, the wireless device using the beamforming antenna 441 can achieve better performance and lower power consumption. It is important to recognize any combination of reconfigurable parasitic elements can be used in conjunction with the primary radiating element. Further, any number of primary and reconfigurable parasitic elements can be used. For example, two primary radiating elements can be used to provide, for instance, polarization diversity. Further, six reconfigurable parasitic elements can be used in conjunction with the two primary radiating elements to cooperatively provide an antenna-pattern beam in a predetermined direction.

In FIG. 4, the adaptive steering of the antenna-pattern beam can be performed using, for instance, switching elements associated with the switching circuit 447 to select parasitic elements 451*a* and 451*b* of the beamforming antenna 441. The selected parasitic elements 451*a* and 451*b* and the primary radiating element 450 can cooperatively receive and radiate RF signals. For example, a plurality of reconfigurable parasitic elements 451*a* and 451*b* such as monopoles, dipoles, or both can be contiguously and uniformly distributed around a primary radiating element 450. Such parasitic elements 451*a* and 451*b* can be adaptively switched to cooperatively work with the primary radiating element 450 to adaptively steer the antenna-pattern beam. It is important to recognize that the beamforming antenna configurations described by this disclosure may also provide polarization diversity, frequency diversity, multiband operation, broadband operation, or any combination thereof. Further, a person of ordinary skill in the art will recognize that there are many different antenna systems, structures, and configurations, which may support a beamforming function as described in this disclosure.

In the current embodiment, the beamforming antenna 441 can be electrically connected to the adaptive matching network 442, which can be used to match the input impedance of the beamforming antenna 441, for instance, after switching to the desired parasitic element or elements is made to improve the power transfer and reduce reflections from the beamforming antenna 441. Further, the adaptive matching network 442 can be used to estimate the input impedance of the beamforming antenna 441. The transceiver 405 can include a transmitter, a receiver, or both. On the downlink, the input to the transceiver 405 can be an RF signal, which can be converted from an electromagnetic signal to an electrical signal via the beamforming antenna 441. The output of the transceiver 405 can be a baseband signal or an intermediate frequency ("IF") signal. Similarly, on the uplink, the input to the transceiver 405 can be a baseband signal or an IF signal. The output of the transceiver 405 can be an RF signal, which can be converted from an electrical signal to an electromagnetic signal by the beamforming antenna 441. The detailed design of the transceiver 405 is dependent on the wireless communication system used.

In FIG. 4, the usage detector 444 can be used to determine the operating environment of the wireless device, which may be used to further adapt or control the antenna-pattern beam of the beamforming antenna 441. The usage detector 444 can receive a signal from the adaptive matching network 442, a signal from the transceiver 405, a signal from the sensor 423, other signal, or any combination thereof. The usage detector 444 can determine the operating environment of the wireless device by identifying a change in, for instance, the received signal strength of the beamforming antenna 441; the directional alignment of the wireless device; the propagation characteristics of a received signal; the input impedance of the beamforming antenna 441; other information; or any combination thereof.

For instance, the usage detector 444 can determine that the wireless device is placed against a user's ear during a voice call using the call processing state of the wireless device, the directional alignment of the wireless device, a change in the input impedance of the beamforming antenna 441, other factor, or any combination thereof. For example, the usage detector 444 can receive a signal from the sensor 423 indicating that the wireless device is in a substantially horizontal directional alignment consistent with the positioning of the wireless device by a user during a voice call. Further, the controller 403 can provide the usage detector 444 with, for instance, the call processing state of the wireless device such as a voice call state. In addition, the usage detector 444 can monitor for a change in the input impedance of the beamforming antenna 441 using the adaptive matching network 442, which may be used to determine, for instance, that a wireless device is close to the user's body. After determining that the wireless device is placed against a user's ear during a voice call, the controller 403 can switch one or more reconfigurable parasitic elements 451*a* and 451*b* of the beamforming antenna 441 to steer the antenna-pattern beam away from the user's body.

In FIG. 4, the controller 403 can determine to update the antenna-pattern beam of the beamforming antenna 441 by using, for instance, a change in the received signal strength of the beamforming antenna 441; the directional alignment of the wireless device; the propagation characteristics of a received signal via the beamforming antenna 441; the input impedance of the beamforming antenna 441 using the adaptive matching network 442; or any combination thereof. In another embodiment, the controller 403 can measure a plurality of received signal strengths for the beamforming antenna 441, wherein each measurement can correspond to the primary radiating element 450 with one or more different reconfigurable parasitic elements 451*a* and 451*b*. Further, the controller 403 can determine to adaptively steer the beamforming antenna 441 by, for instance, comparing one or more of such received signal strengths to the received signal strength of the currently configured beamforming antenna. If one or more of such received signal strengths is sufficiently greater than the received signal strength of the currently configured beamforming antenna, then the controller 403 can switch to the one or more reconfigurable parasitic elements 451*a* and 451*b* corresponding to the greater received signal strength by using the switching circuit 447.

Figure 5:
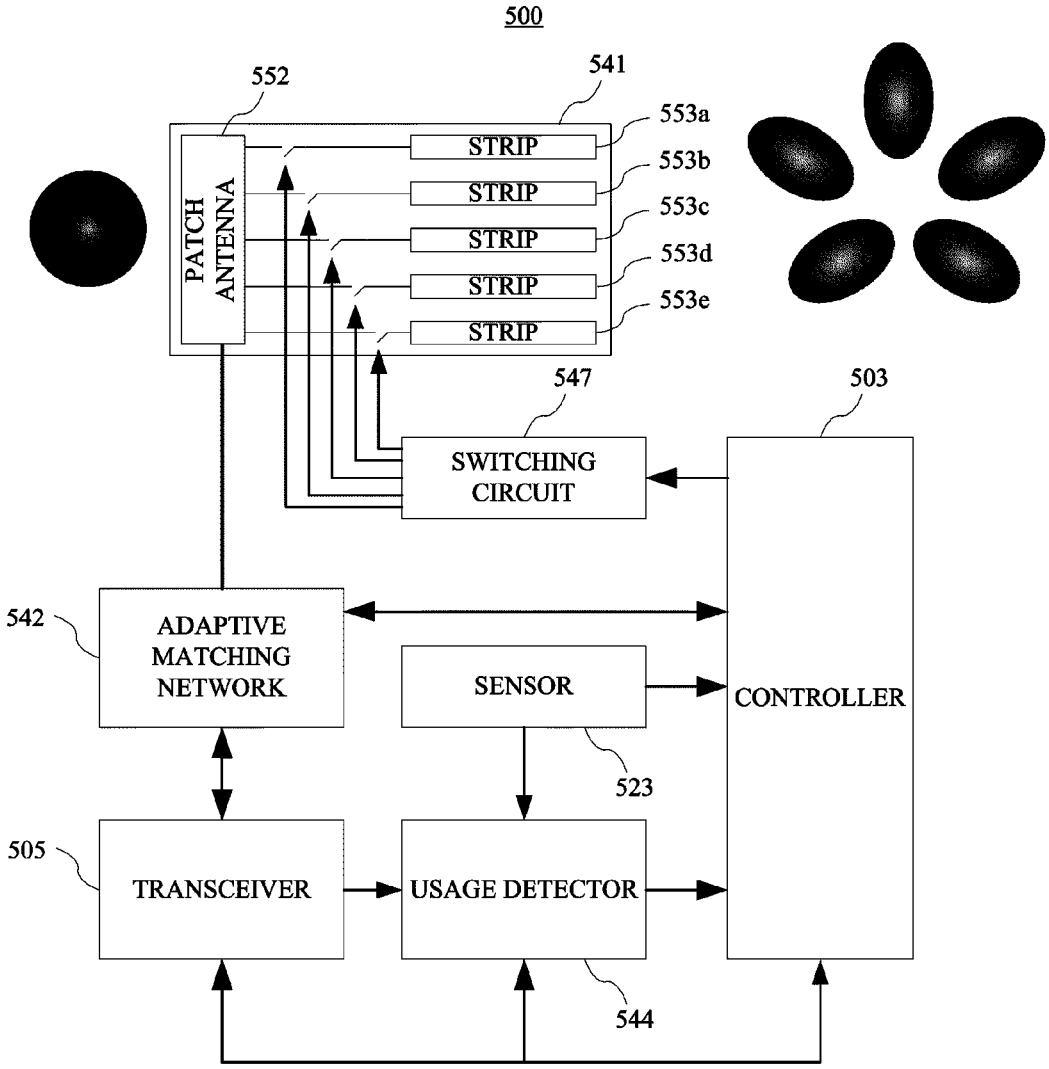
FIG. 5 illustrates a block diagram of another embodiment of a beamforming antenna system for a wireless device in accordance with various aspects set forth herein.

FIG. 5 illustrates a block diagram of another embodiment of a beamforming antenna system 500 for a wireless device in accordance with various aspects set forth herein. In FIG. 5, the system 500 can include a beamforming antenna 541, an adaptive matching network 542, a transceiver 505, a usage detector 544, a sensor 523, a controller 503, a switching circuit 547, other element, or any combination thereof. The beamforming antenna 541 can include a primary radiating element 552 with one or more reconfigurable parasitic elements 553*a* to 553*e*. In this embodiment, the primary radiating element 552 is a patch antenna. Further, each of the reconfigurable parasitic elements 553*a* to 553*e* is a radiating strip or patch element.

A patch antenna typically is a miniaturized antenna radiating structure, such as a planar inverted-F antenna ("PIFA"). Patch antennas are popular for use in wireless devices due to their low profile, ability to conform to surface profiles, and unlimited shapes and sizes. Patch antenna polarization can be linear or elliptical, with a main polarization component parallel to the surface of the patch antenna. Operating characteristics of patch antennas are predominantly established by their shape and dimensions. The patch antenna is typically fabricated using printed-circuit techniques and integrated with a printed circuit board ("PCB"). The patch antenna is typically electrically coupled to a ground area, wherein the ground area is typically formed on or in a PCB. Patch antennas are typically spaced from and parallel to the ground area and are typically located near other electronic components, ground planes, and signal traces, which may impact the design and performance of the antenna. In addition, patch antennas are typically considered to be lightweight, compact, and relatively easy to manufacture and integrate into a wireless device.

A patch antenna design can include one or more slots in the antenna's radiating member. Selection of the position, shape, contour, and length of a slot depends on the design requirements of the particular patch antenna. The function of a slot in a patch antenna design includes physically partitioning the radiating member of a single-band patch antenna into a subset of radiating members for multiple-band operation, providing reactive loading to modify the resonant frequencies of a radiating member, and controlling the polarization characteristics of a multiple-band patch antenna. In addition to a slot, radiating members of a patch antenna can have stub members, usually consisting of a tab at the end of a radiating member. The function of a stub member includes providing reactive loading to modify the resonant frequencies of a radiating member.

The beamforming antenna 541 can direct an electromagnetic beam radiated from the beamforming antenna 541 to improve the quality of a transmitted signal, received signal, or both. For example, the beamforming antenna 541 can steer the antenna-pattern beam towards a base station while traveling throughout the coverage area of the base station. Further, the beamforming antenna 541 can direct the antenna-pattern beam away from a user of the associated wireless device to reduce the amount of electromagnetic energy absorbed by such user. Also, by directing the antenna-pattern beam of the beamforming antenna 541 towards a receiving antenna such as at a base station can reduce the amount of interference received by other wireless devices. By more effectively and efficiently receiving RF signals, radiating RF signals, or both, the wireless device using the beamforming antenna 541 can achieve lower power consumption.

In FIG. 5, the steering of the antenna-pattern beam can be performed using, for instance, switching elements associated with the switching circuit 547 to select reconfigurable parasitic elements of the beamforming antenna 541. The selected parasitic elements and the primary radiating element can cooperatively receive and radiate RF signals. For example, a plurality of radiating strip elements 553*a* to 553*e* can be adaptively switched to cooperatively work with the patch antenna 552 to steer the antenna-pattern beam. It is important to recognize that the aforementioned beamforming antenna configurations may also provide polarization diversity, frequency diversity, multiband operation, broadband operation, or any combination thereof.

In the current embodiment, the beamforming antenna 541 can be electrically connected to the adaptive matching network 542, which can be used to match the input impedance of the beamforming antenna 541 to improve the power transfer and reduce reflections from the beamforming antenna 541. Further, the adaptive matching network 542 can be used to estimate the input impedance of the beamforming antenna 541. The transceiver 505 can include a transmitter, a receiver, or both. On the downlink, the input to the transceiver 505 can be an RF signal, which can be converted from an electromagnetic signal to an electrical signal via the beamforming antenna 541. The output of the transceiver 505 can be a baseband signal or an intermediate frequency ("IF") signal. Similarly, on the uplink, the input to the transceiver 505 can be a baseband signal or an IF signal. The output of the transceiver 505 can be an RF signal, which can be converted from an electrical signal to an electromagnetic signal by the beamforming antenna 541. The detailed design of the transceiver 505 is dependent on the wireless communication system used.

In FIG. 5, the usage detector 544 can be used to determine the operating environment of the wireless device, which may be used to further adapt the antenna-pattern beam of the beamforming antenna 541. The usage detector 544 can receive a signal from the adaptive matching network 542, a signal from the transceiver 505, a signal from the sensor 523, other signal, or any combination thereof. The usage detector 544 can determine the operating environment of the wireless device by identifying a change in, for instance, the received signal strength of the beamforming antenna 541; the directional alignment of the wireless device, the propagation characteristics of a received signal; the input impedance of the beamforming antenna 541; other information; or any combination thereof.

For instance, the usage detector 544 can determine that the wireless device is placed against a user's ear during a voice call using the call processing state of the wireless device, the directional alignment of the wireless device, a change in the input impedance of the beamforming antenna 541, other factor, or any combination thereof. For example, the usage detector 544 can receive a signal from the sensor 523 indicating that the wireless device is in a substantially horizontal directional alignment consistent with the positioning of the wireless device by a user during a voice call. Further, the controller 503 can provide the usage detector 544 with, for instance, the call processing state of the wireless device such as a voice call state. In addition, the usage detector 544 can monitor for a change in the input impedance of the beamforming antenna 541 using the adaptive matching network 542, which may be used to, for instance, initiate the adaptive beam steering operation after determining that a wireless device is close to the user's body. After determining that the wireless device is placed against a user's ear during a voice call, the controller 503 can switch one or more radiating strip elements 553*a* to 553*e* of the beamforming antenna 541 to steer the antenna-pattern beam away from the user's body.

In FIG. 5, the controller 503 can determine to update the antenna-pattern beam of the beamforming antenna 541 by using, for instance, a change in the received signal strength of the beamforming antenna 541, the directional alignment of the wireless device, the propagation characteristics of a received signal via the beamforming antenna 541, the input impedance of the beamforming antenna 541 using the adaptive matching network 542, or any combination thereof. In another embodiment, the controller 503 can measure a plurality of received signal strengths for the beamforming antenna 541, wherein each measurement can correspond to the primary radiating element with one or more different reconfigurable parasitic elements. Further, the controller 503 can determine to steer the beamforming antenna 541 by, for instance, comparing one or more of such received signal strengths to the received signal strength of the currently configured beamforming antenna.

Figure 6:
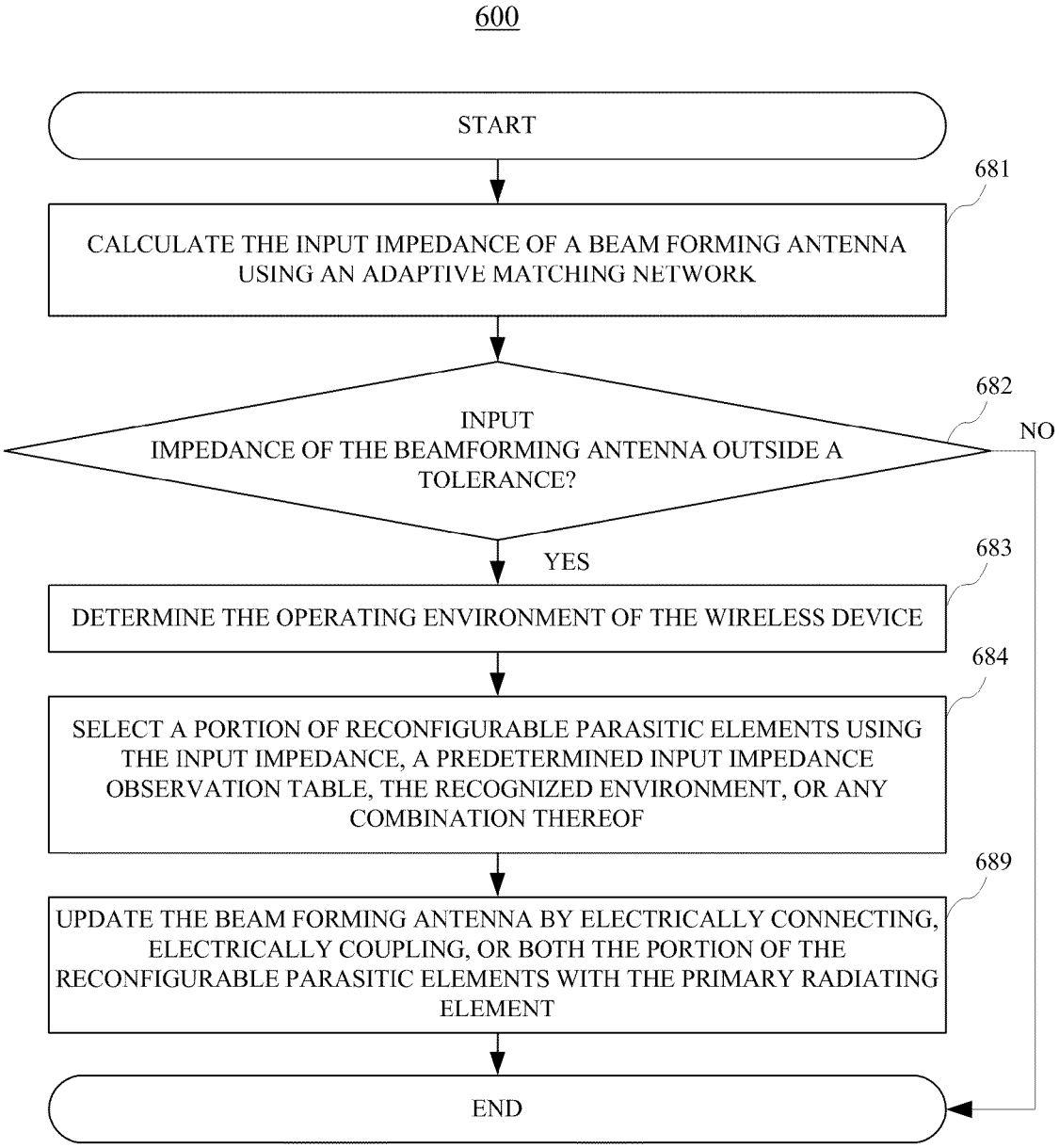
FIG. 6 is a flow chart of one embodiment of a method of adapting a beamforming antenna using reconfigurable parasitic elements in accordance with various aspects set forth herein.

FIG. 6 is a flow chart of one embodiment of a method 600 of adapting a beamforming antenna using reconfigurable parasitic elements in accordance with various aspects set forth herein. In FIG. 6, the method 600 can start at block 681, where the method 600 can calculate the input impedance of the beamforming antenna using an adaptive matching network, wherein the adaptive matching network is electrically connected to the beamforming antenna. At block 682, the method 600 can determine whether the input impedance of the beamforming antenna is outside a tolerance. The tolerance can reflect the variability of the input impedance of the beamforming antenna while in a static environment. For instance, the tolerance can be correlated to the variance of the input impedance of the beamforming antenna while in a specific environment. The quality of the design of the beamforming antenna, the quality of the components used for the beamforming antenna, environmental conditions, other factor, or any combination thereof may impact the tolerance of the beamforming antenna.

If the input impedance is outside the tolerance of the beamforming antenna, at block 683, the method 600 can determine the operating environment of the wireless device using, for instance, the received signal strength of the beamforming antenna, the propagation characteristics of a received signal via the beamforming antenna, the input impedance of the beamforming antenna, the speed of the wireless device, the delay spread of signals received at the beamforming antenna, the directional alignment of the wireless device, other factor, or any combination thereof. The method 600 can use a sensor such as an accelerometer to determine, for instance, the directional alignment of the wireless device, the speed of the wireless device, the acceleration of the wireless device, other factor, or any combination thereof. In another embodiment, the method 600 can use a sensor such as a camera to monitor contiguous images to determine whether the wireless device is placed against or near a user's ear.

In FIG. 6, at block 684, the method 600 can select a set of one or more reconfigurable parasitic elements using, for instance, the input impedance, a predetermined input impedance observation table, the recognized operating environment, other factor, or any combination thereof. For example, the method 600 can compare the measured input impedance of the beamforming antenna to entries in the predetermined input impedance observation table to select one or more reconfigurable parasitic elements. The predetermined input impedance observation table can be derived by capturing the measurements of the input impedance of the beamforming antenna under various environments and conditions. The various environments and conditions can be, for instance, the presence of a user or an object near the beamforming antenna of a wireless device; an RF signal transmitted from a specific direction towards the beamforming antenna of a wireless device; the propagation environment; other condition or environment; or any combination thereof. At block 689, the method 600 can update the beamforming antenna by electrically connecting, electrically coupling, or both the set of one or more reconfigurable parasitic elements with the primary radiating element. The input impedance matching of the beamforming antenna formed by the primary radiating element electrically connected, electrically coupled, or both to one or more selected parasitic elements can be adaptively optimized for maximum power transfer using the calculated impedance value.

Figure 7:
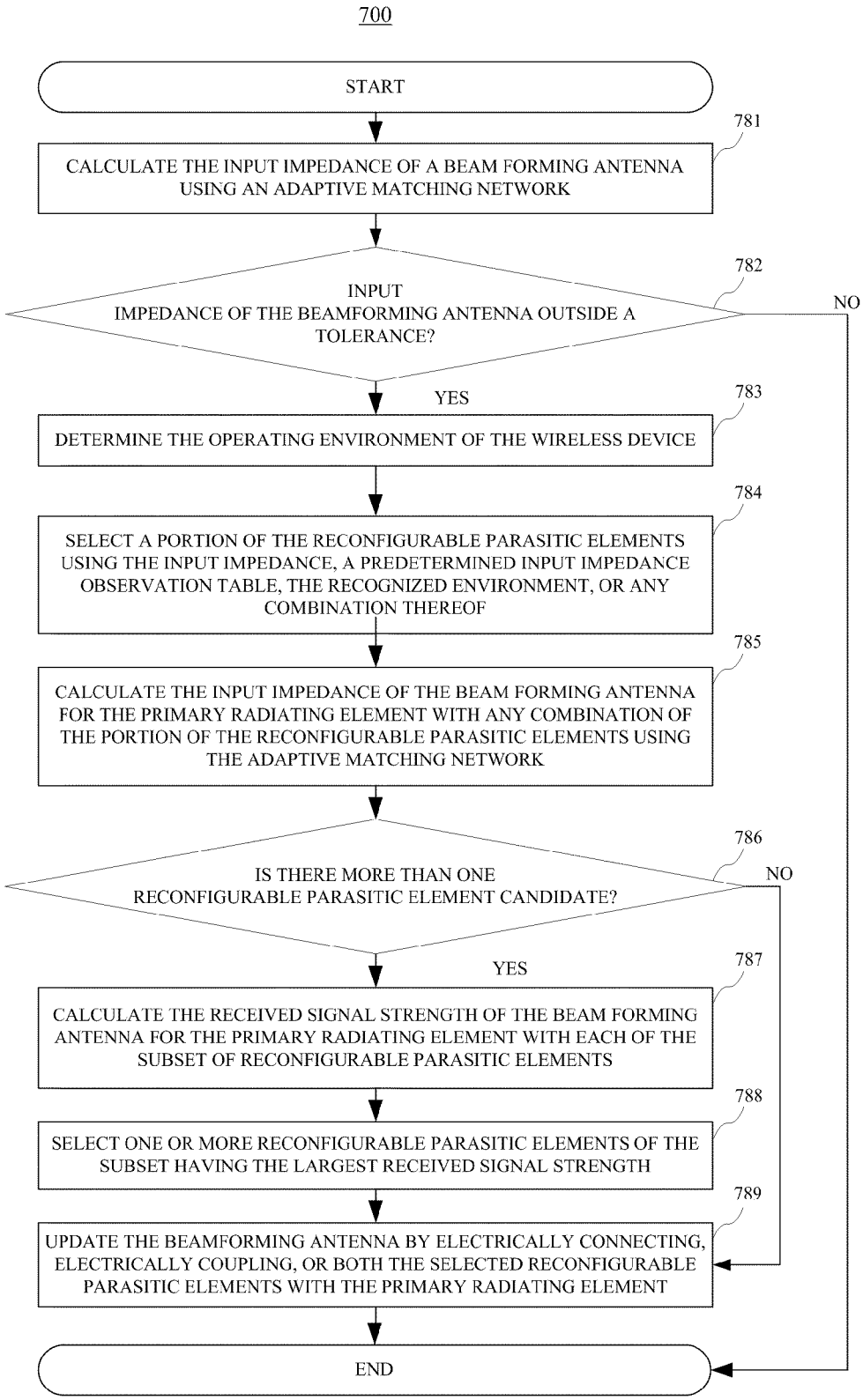
FIG. 7 is a flow chart of another embodiment of a method of adapting a beamforming antenna using reconfigurable parasitic elements in accordance with various aspects set forth herein.

FIG. 7 is a flow chart of one embodiment of a method 700 of adapting a beamforming antenna using reconfigurable parasitic elements in accordance with various aspects set forth herein. In FIG. 7, the method 700 can start at block 781, where the method 700 can calculate the input impedance of the beamforming antenna using an adaptive matching network, wherein the adaptive matching network is electrically connected to the beamforming antenna. At block 782, the method 700 can determine whether the input impedance of the beamforming antenna is outside a tolerance. The tolerance can reflect the variability of the input impedance of the beamforming antenna while in, for instance, a static environment. For example, the tolerance can be correlated to the variance of the input impedance of the beamforming antenna while in a specific environment. The quality of the design of the beamforming antenna, the quality of the components used for the beamforming antenna, environmental conditions, other factor, or any combination thereof may impact the tolerance of the beamforming antenna.

If the input impedance is outside the tolerance of the beamforming antenna, at block 783, the method 700 can determine the operating environment of the wireless device using, for instance, the received signal strength of the beamforming antenna, the propagation characteristics of a received signal via the beamforming antenna, the input impedance of the beamforming antenna, the speed of the wireless device, the delay spread of signals received at the beamforming antenna, the directional alignment of the wireless device, other factor, or any combination thereof. The method 700 can use a sensor such as an accelerometer to determine, for instance, the directional alignment of the wireless device, the speed of the wireless device, the acceleration of the wireless device, other factor, or any combination thereof. In another embodiment, the method 700 can use a sensor such as a camera to monitor contiguous images to determine whether the wireless device is placed against or near a user's ear.

In FIG. 7, at block 784, the method 700 can select a portion of one or more reconfigurable parasitic elements using, for instance, the input impedance, a predetermined input impedance observation table, the recognized operating environment, other factor, or any combination thereof. For example, the method 700 can compare the measured input impedance of the beamforming antenna to entries in the predetermined input impedance observation table to select one or more reconfigurable parasitic elements. The predetermined input impedance observation table can be derived by capturing the measurements of the input impedance of the beamforming antenna under various environments and conditions. The various environments and conditions can be, for instance, the presence of a user or an object; an RF signal transmitted from a specific direction towards the beamforming antenna; the propagation environment; other condition; or any combination thereof.

At block 785, the method 700 can calculate the input impedance of the beamforming antenna for each of the portion of reconfigurable parasitic elements using the adaptive matching network. At block 786, the method 700 can determine whether to consider more than one parasitic element configuration using the input impedance calculated at block 785. If more than one parasitic element configuration is considered, then at block 787 the method 700 can calculate the received signal strength of the beamforming antenna for the primary radiating element with any combination of the parasitic element configurations. At block 788, the method 700 can select one or more of the parasitic element configurations having the largest received signal strength. At block 789, the method 700 can update the beamforming antenna by electrically connecting, electrically coupling, or both the selected parasitic element configuration or configurations with the primary radiating element by using, for instance, a switching circuit. The input impedance match of the antenna formed by the primary radiating element electrically connected, electrically coupled, or both to one or more of the selected parasitic elements can be adaptively updated to improve the power transfer of the beamforming antenna by using the adaptive matching network to calculate the input impedance value.

Figure 8:
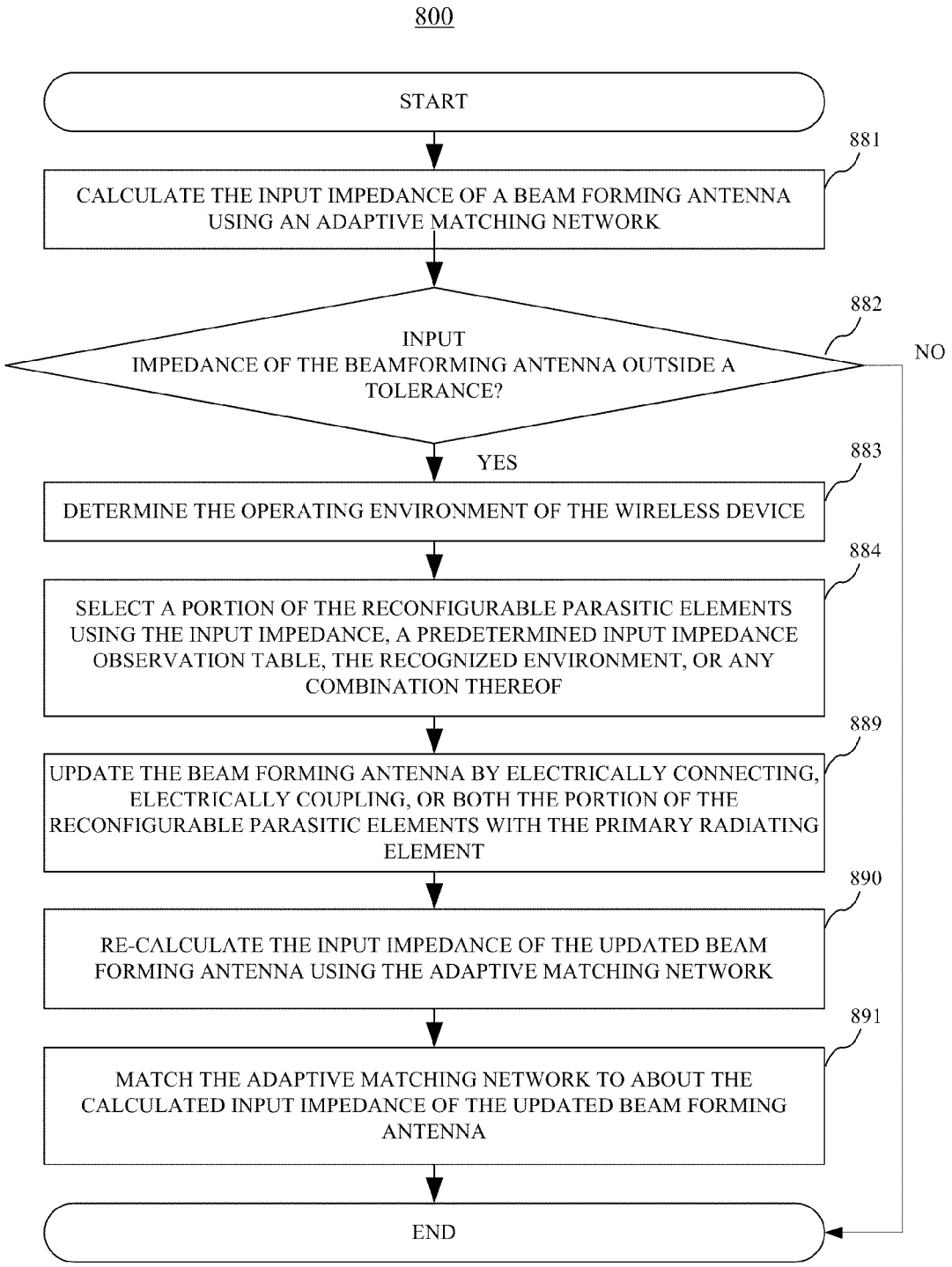
FIG. 8 is a flow chart of another embodiment of a method of adapting a beamforming antenna using reconfigurable parasitic elements in accordance with various aspects set forth herein.

FIG. 8 is a flow chart of another embodiment of a method 800 of adapting a beamforming antenna using reconfigurable parasitic elements in accordance with various aspects set forth herein. In FIG. 8, the method 800 can start at block 881, where the method 800 can calculate the input impedance of the beamforming antenna using an adaptive matching network, wherein the adaptive matching network is electrically connected to the beamforming antenna. At block 882, the method 800 can determine whether the input impedance of the beamforming antenna is outside a tolerance. The tolerance can reflect the variability of the input impedance of the beamforming antenna while in a static environment. For instance, the tolerance can be correlated to the variance of the input impedance of the beamforming antenna while in a specific environment. The quality of the design of the beamforming antenna, the quality of the components used for the beamforming antenna, environmental conditions, other factor, or any combination thereof may impact the tolerance of the beamforming antenna.

If the input impedance is outside the tolerance of the beamforming antenna, at block 883, the method 800 can determine the operating environment of the wireless device using, for instance, the received signal strength of the beamforming antenna, the propagation characteristics of a received signal via the beamforming antenna, the input impedance of the beamforming antenna, the speed of the wireless device, the delay spread of signals received at the beamforming antenna, the directional alignment of the wireless device, other factor, or any combination thereof. The method 800 can use a sensor such as an accelerometer to determine, for instance, the directional alignment of the wireless device, the speed of the wireless device, the acceleration of the wireless device, other factor, or any combination thereof. In another embodiment, the method 800 can use a sensor such as a camera to monitor contiguous images to determine whether the wireless device is placed against or near a user's ear.

In FIG. 8, at block 884, the method 800 can select a set of one or more reconfigurable parasitic elements using, for instance, the input impedance, a predetermined input impedance observation table, the recognized operating environment, other factor, or any combination thereof. For example, the method 800 can compare the measured input impedance of the beamforming antenna to entries in the predetermined input impedance observation table to select one or more reconfigurable parasitic elements. The predetermined input impedance observation table can be derived by capturing the measurements of the input impedance of the beamforming antenna under various environments and conditions. The various environments and conditions can be, for instance, the presence of a user or an object; an RF signal transmitted from a specific direction towards the beamforming antenna; the propagation environment of the wireless device; other condition; or any combination thereof. At block 889, the method 800 can update the beamforming antenna by electrically connecting, electrically coupling, or both the set of one or more reconfigurable parasitic elements with the primary radiating element. After updating the beamforming antenna, at block 890, the method 800 can re-calculate the input impedance of the updated beamforming antenna using, for instance, the adaptive matching network. At block 891, the method 900 can then match the adaptive matching network to about the same calculated input impedance of the updated beamforming antenna.

Figure 9:
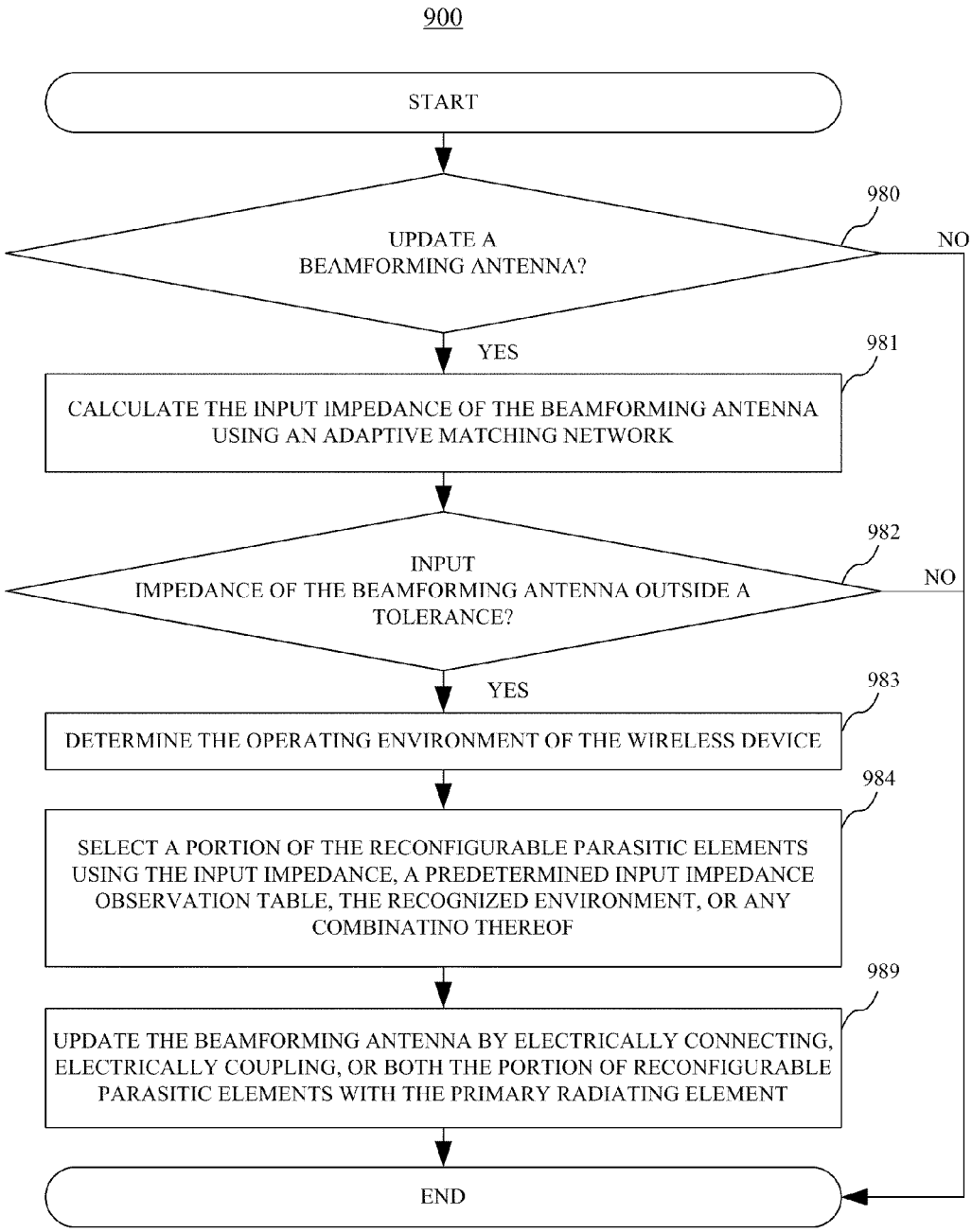
FIG. 9 is a flow chart of another embodiment of a method of adapting a beamforming antenna using reconfigurable parasitic elements in accordance with various aspects set forth herein.

FIG. 9 is a flow chart of another embodiment of a method 900 of adapting a beamforming antenna using reconfigurable parasitic elements in accordance with various aspects set forth herein. In FIG. 9, the method 900 can start at block 980, where the method 900 can determine whether to update the beamforming antenna by, for instance, determining a change in the received signal strength of the beamforming antenna, the directional alignment of the wireless device, the propagation characteristics of a received signal via the beamforming antenna, the input impedance of the beamforming antenna, or any combination thereof. In another embodiment, the method 900 can measure a plurality of received signal strengths of the beamforming antenna, wherein each measurement corresponds to a primary radiating element of the beamforming antenna with one or more different reconfigurable parasitic elements. Further, the method 900 can determine to update the beamforming antenna by determining whether one of the plurality of received signal strengths corresponding to a specific configuration of one or more reconfigurable parasitic elements with the primary radiating element is greater than the received signal strength of the currently configured beamforming antenna. If one of the plurality of received signal strengths is greater than the received signal strength of the currently configured beamforming antenna, then the method 900 can update the beamforming antenna.

At block 981, the method 900 can calculate the input impedance of the beamforming antenna using an adaptive matching network, wherein the adaptive matching network is electrically connected to the beamforming antenna. At block 982, the method 900 can determine whether the input impedance of the beamforming antenna is outside a tolerance. The tolerance can reflect the variability of the input impedance of the beamforming antenna while in a specific environment such as a static environment. For instance, the tolerance can be correlated to the variance of the input impedance of the beamforming antenna while in a specific environment. The quality of the design of the beamforming antenna, the quality of the components used for the beamforming antenna, environmental conditions, other factor, or any combination thereof may impact the tolerance of the beamforming antenna.

If the input impedance is outside the tolerance of the beamforming antenna, at block 983, the method 900 can determine the operating environment of the wireless device using, for instance, the received signal strength, the propagation characteristics of the received signal, the input impedance of the beamforming antenna, the speed of the wireless device, the delay spread of signals received at the beamforming antenna, the directional alignment of the wireless device, other factor, or any combination thereof. The method 900 can use a sensor such as an accelerometer to determine, for instance, the directional alignment of the wireless device, the speed of the wireless device, the acceleration of the wireless device, other factor, or any combination thereof. In another embodiment, the method 900 can use a sensor such as a camera to monitor contiguous images to determine whether the wireless device is placed against or near a user's ear.

In FIG. 9, at block 984, the method 900 can select a portion of one or more reconfigurable parasitic elements using, for instance, the measured input impedance of the beamforming antenna, a predetermined input impedance observation table, the recognized operating environment, other factor, or any combination thereof. For example, the method 900 can compare the measured input impedance of the beamforming antenna to entries in the predetermined input impedance observation table to select the set of one or more reconfigurable parasitic elements. The predetermined input impedance observation table can be derived by capturing the measurements of the input impedance of the beamforming antenna under various environments and conditions. The various environments and conditions can be, for instance, the presence of a user or an object; an RF signal transmitted from a specific direction towards the beamforming antenna; the propagation environment of the wireless device; other condition; or any combination thereof. At block 988, the method 900 can update the beamforming antenna by electrically connecting, electrically coupling, or both the set of one or more reconfigurable parasitic elements with the primary radiating element.

Figure 10:
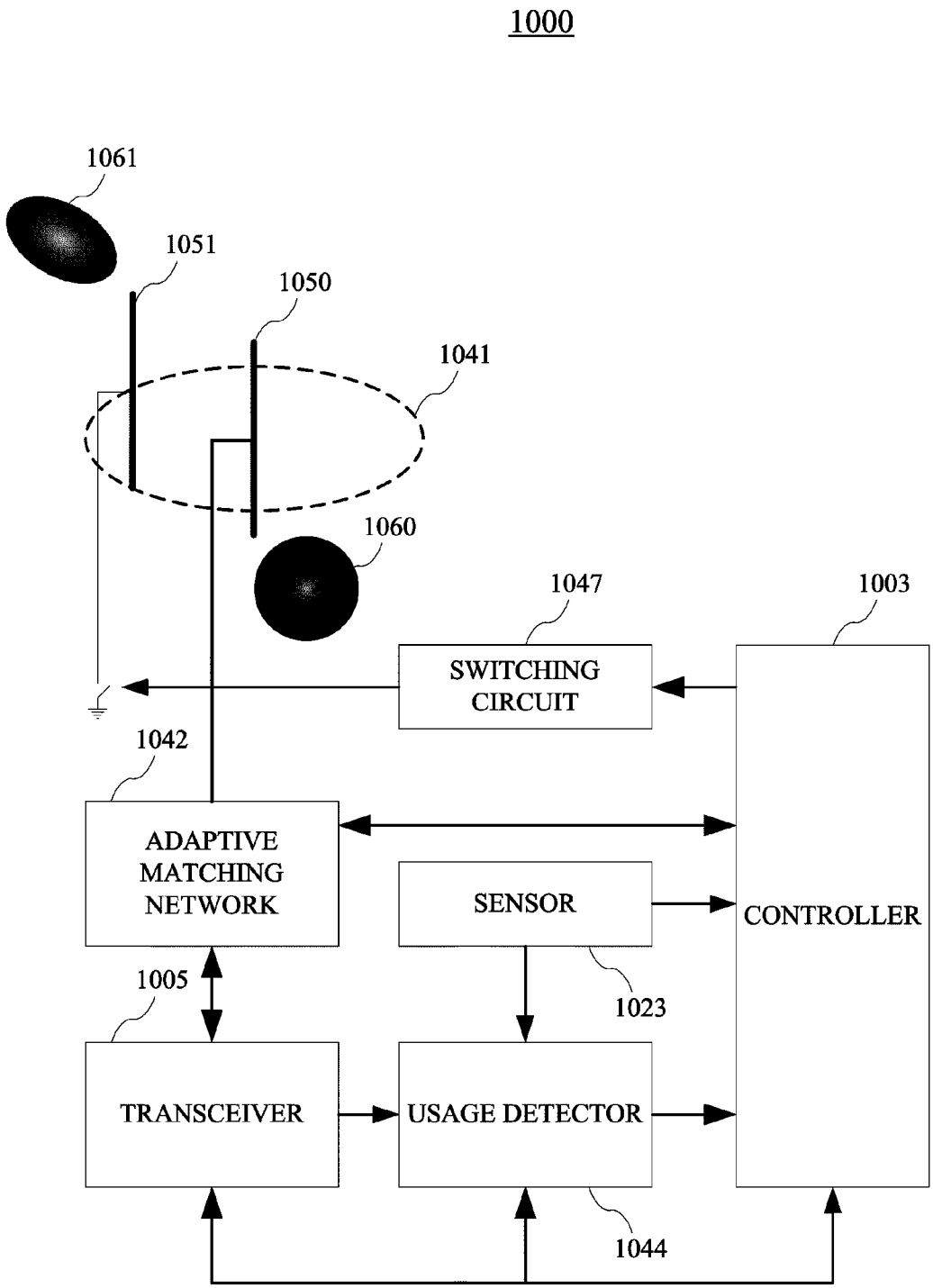
FIG. 10 illustrates a block diagram of another embodiment of a beamforming antenna system for a wireless device in accordance with various aspects set forth herein.

FIG. 10 illustrates a block diagram of another embodiment of a beamforming antenna system 1000 for a wireless device in accordance with various aspects set forth herein. In FIG. 10, the system 1000 can include a beamforming antenna 1041, an adaptive matching network 1042, a transceiver 1005, a usage detector 1044, a sensor 1023, a controller 1003, a switching circuit 1047, other element, or any combination thereof. The beamforming antenna 1041 can include a primary radiating element 1050 with a reconfigurable parasitic elements 1051. In this embodiment, the primary radiating element 1050 is a monopole or a dipole, and the reconfigurable parasitic element 1051 is a monopole or a dipole.

Under normal operation of the wireless device, the beamforming antenna can use the primary radiating element 1050 to generate an omnidirectional antenna-pattern beam 1060. When, for instance, the wireless device is placed to the user's ear, the beamforming antenna 1041 can direct the antenna-pattern beam 1061 away from the user to reduce the amount of electromagnetic energy absorbed by such user. The directing of the antenna-pattern beam away from a user can be performed using, for instance, a switching element associated with the switching circuit 1047 to select the parasitic element 1051 of the beamforming antenna 1041. The parasitic element 1051 and the primary radiating element 1050 can cooperatively receive and radiate RF signals.

In the current embodiment, the beamforming antenna 1041 can be electrically connected to the adaptive matching network 1042, which can be used to match the input impedance of the beamforming antenna 1041 to improve the power transfer and reduce reflections from the beamforming antenna 1041. Further, the adaptive matching network 1042 can be used to estimate the input impedance of the beamforming antenna 1041. The transceiver 1005 can include a transmitter, a receiver, or both. On the downlink, the input to the transceiver 1005 can be an RF signal, which can be converted from an electromagnetic signal to an electrical signal via the beamforming antenna 1041. The output of the transceiver 1005 can be a baseband signal or an intermediate frequency ("IF") signal. Similarly, on the uplink, the input to the transceiver 1005 can be a baseband signal or an IF signal. The output of the transceiver 1005 can be an RF signal, which can be converted from an electrical signal to an electromagnetic signal by the beamforming antenna 1041. The detailed design of the transceiver 1005 is dependent on the wireless communication system used.

In FIG. 10, the usage detector 1044 can be used to determine the operating environment of the wireless device, which can be used to determine when to switch the parasitic element 1051 of the beamforming antenna 1041. The usage detector 1044 can receive a signal from the adaptive matching network 1042, a signal from the transceiver 1005, a signal from the sensor 1023, other signal, or any combination thereof. The usage detector 1044 can determine the operating environment of the wireless device by identifying a change in, for instance, the received signal strength of the beamforming antenna 1041; the directional alignment of the wireless device, the propagation characteristics of a received signal; the input impedance of the beamforming antenna 1041; other information; or any combination thereof.

For instance, the usage detector 1044 can determine that the wireless device is placed against a user's ear during a voice call using the call processing state of the wireless device, the directional alignment of the wireless device, a change in the input impedance of the beamforming antenna 1041, other factor, or any combination thereof. For example, the usage detector 1044 can receive a signal from the sensor 1023 indicating that the wireless device is in a substantially horizontal directional alignment consistent with the positioning of the wireless device by a user during a voice call. Further, the controller 1003 can provide the usage detector 1044 with, for instance, the call processing state of the wireless device such as a voice call state. In addition, the usage detector 1044 can monitor for a change in the input impedance of the beamforming antenna 1041 using the adaptive matching network 1042, which may be used to determine, for instance, that a wireless device is close to the user's body. After determining that the wireless device is placed against a user's ear during a voice call, the controller 1003 can switch the parasitic element 1051 of the beamforming antenna 1041 to steer the antenna-pattern beam away from the user's body.

Figure 11:
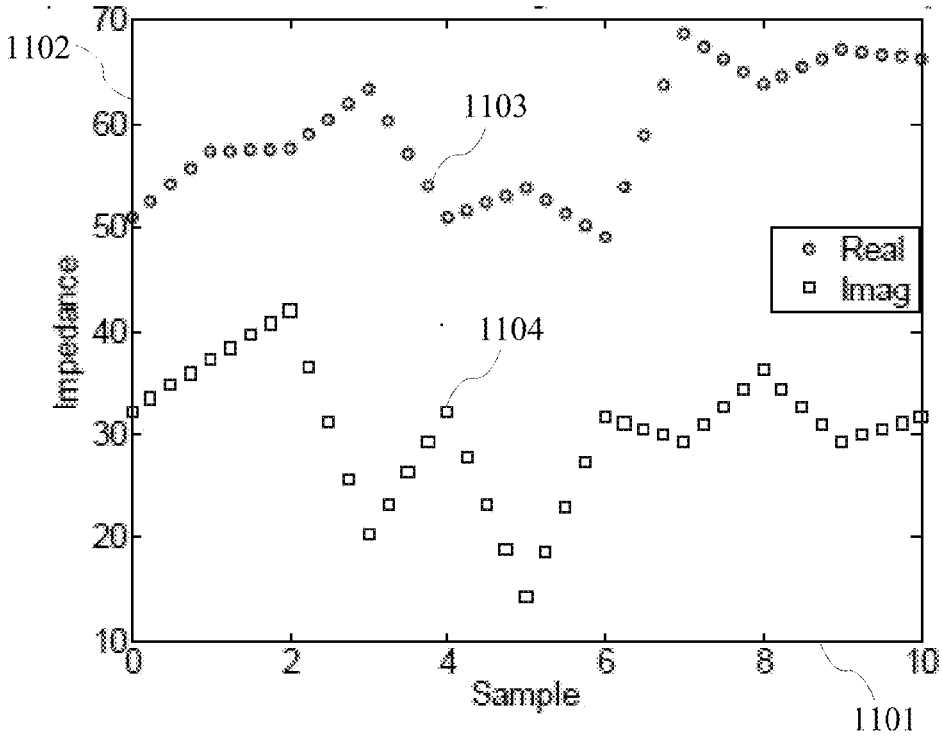
FIG. 11 illustrates simulated results of the performance of one embodiment of a beamforming antenna system in accordance with various aspects set forth herein.

FIG. 11 illustrates simulated results of the performance of one embodiment of a beamforming antenna system 400 in accordance with various aspects set forth herein, wherein the results show the measured input impedance of the beamforming antenna 441 over time for a user operating a wireless device in a voice call. The graphical representation in its entirety is referred to by 1100. The number of the discrete-time sample of the measured input impedance of the beamforming antenna 441 is shown on the abscissa 1101. The measured input impedance of the beamforming antenna 441 is shown on the ordinate 1102. The graph 1103 shows the real values of the measured input impedance of the beamforming antenna 441. The graph 1104 shows the imaginary values of the measured input impedance of the beamforming antenna 441. In the simulation, the beamforming antenna 441 uses a half-wavelength dipole for the primary radiating element 450 and five half-wavelength dipoles for the reconfigurable parasitic elements 451*a* to 451*e*. Each of the five reconfigurable parasitic elements 451*a* to 451*e* are one tenth of a wavelength from the primary radiating element 450. Further, the antenna gain of the primary radiating element 450 is 1.65 dB and the antenna gain of the primary radiating element coupled with one of the reconfigurable parasitic elements 451*a* to 451*e* is 4.99 dB. The simulation was performed at a frequency of 900 MHz.

Having shown and described exemplary embodiments, further adaptations of the methods, devices, and systems described herein may be accomplished by appropriate modifications by one of ordinary skill in the art without departing from the scope of the present disclosure. Several of such potential modifications have been mentioned, and others will be apparent to those skilled in the art. For instance, the exemplars, embodiments, and the like discussed above are illustrative and are not necessarily required. Accordingly, the scope of the present disclosure should be considered in terms of the following claims and is understood not to be limited to the details of structure, operation, and function shown and described in the specification and drawings.

As set forth above, the described disclosure includes the aspects set forth below.

What is claimed is:

1. A method of controlling an antenna-pattern of a beamforming antenna in a wireless device, comprising:

calculating the input impedance of the beamforming antenna using an adaptive matching network, wherein said beamforming antenna includes a primary radiating element and one or more reconfigurable parasitic elements to shape and direct the antenna-pattern, and said primary radiating element and said reconfigurable parasitic elements cooperatively receive, transmit, or both a radio frequency signal;

determining that the input impedance of the beamforming antenna is outside a tolerance;

recognizing an environment of the wireless device;

selecting a portion of said reconfigurable parasitic elements using the input impedance of the beamforming antenna, an input impedance observation table, said recognized environment, or any combination thereof; and updating the beamforming antenna by electrically connecting, electrically coupling, or both said selected portion of said reconfigurable parasitic elements to said primary radiating element to adaptively steer the antenna-pattern in a preferred direction.

2. The method of claim 1, further comprising:

calculating the input impedance of the beamforming antenna for said primary radiating element with each reconfigurable parasitic element of said portion using the adaptive matching network;

determining a subset of said portion of reconfigurable parasitic elements to match the calculated input impedance;

calculating the received signal strength of the beamforming antenna for said primary radiating element with each reconfigurable parasitic element in said subset; and selecting one or more reconfigurable parasitic elements of said subset having the largest received signal strength.

3. The method of claim 1, further comprising:

re-calculating the input impedance of said updated beamforming antenna using said adaptive matching network; and adjusting said adaptive matching network to match the input impedance of said updated beamforming antenna.

4. The method of claim 1, wherein said primary radiating element and said reconfigurable parasitic elements are monopoles or dipoles.

5. The method of claim 1, wherein said primary radiating element is a patch antenna and said reconfigurable parasitic elements are one or more radiating strip elements, wherein said patch antenna is electrically connected, electrically coupled, or both to said radiating strip elements.

6. The method of claim 1, said recognizing including:

identifying a change in one or more of the received signal strength of the beamforming antenna, the directional alignment of the wireless device, the propagation characteristics of a received signal via the beamforming antenna, the input impedance of the beamforming antenna, or any combination thereof.

7. The method of claim 1, further comprising:

determining to update the beamforming antenna.

8. The method of claim 7, said determining to update the beamforming antenna including:

determining a change in one or more of the received signal strength of the beamforming antenna, the directional alignment of the wireless device, the propagation characteristics of a received signal via the beamforming antenna, the input impedance of the beamforming antenna, or any combination thereof.

9. The method of claim 7, said determining to update the beamforming antenna including:

measuring a plurality of received signal strengths for the beamforming antenna, wherein each measurement corresponds to said primary radiating element with one or more different reconfigurable parasitic elements;

determining one of said plurality of received signal strengths is greater than the received signal strength for the beamforming antenna.

10. The method of claim 1, wherein the primary radiating element is used to provide an omnidirectional antenna-pattern beam.

11. An antenna system for a wireless device, comprising:

a beamforming antenna for generating an antenna-pattern beam, said beamforming antenna comprising:

a primary radiating element electrically connected to an adaptive matching network, wherein said adaptive matching network is used for matching the input impedance of said beamforming antenna;

one or more reconfigurable parasitic elements electrically connected, electrically coupled, or both to said primary radiating element and electrically connected to a switching circuit, wherein said switching circuit is used to select one or more of said reconfigurable parasitic elements, and said primary radiating element and said selected parasitic elements cooperatively receive, transmit, or both a radio frequency signal, the parasitic elements for shaping and directing the antenna-pattern;

a transceiver electrically connected to said beamforming antenna for transmitting a signal, receiving a signal, or both;

a usage detector electrically connected to said beamforming antenna and said transceiver for recognizing the environment of the wireless device; and a controller electrically connected to said beamforming antenna, said usage detector, said transceiver, said switching circuit, and said adaptive matching network to adapt the antenna-pattern beam of said beamforming antenna, wherein said controller is configured to:

determine that the input impedance of the beamforming antenna using said adaptive matching network is outside a tolerance;

recognize the environment of the wireless device using said usage detector;

select a portion of said reconfigurable parasitic elements using the input impedance of the beamforming antenna, an observation table, said recognized environment, or any combination thereof; and update the beamforming antenna by electrically connecting, electrically coupling, or both said selected portion of reconfigurable parasitic elements with said primary radiating element using said switching circuit, to adaptively steer the antenna-pattern in a preferred direction.

12. The antenna system of claim 11, wherein said usage detector further comprises:

a sensor for determining the directional alignment of the wireless device, the speed of the wireless device, the acceleration of the wireless device, or any combination thereof.

13. The antenna system of claim 11, wherein said controller is further configured to:

calculate the input impedance of the beamforming antenna for said primary radiating element with each reconfigurable parasitic element of said portion using the adaptive matching network;

determine a subset of said portion of reconfigurable parasitic elements to match the calculated input impedance;

calculate the received signal strength of the beamforming antenna for said primary radiating element with combinations of reconfigurable parasitic elements in said subset; and select one or more reconfigurable parasitic elements of said subset having the largest received signal strength in said combination with said primary radiating element.

14. The antenna system of claim 11, wherein said controller is further configured to:

re-calculate the input impedance of said updated beamforming antenna using said adaptive matching network; and update said adaptive matching network to the input impedance of said updated beamforming antenna.

15. The antenna system of claim 11, wherein said primary radiating element and said reconfigurable parasitic elements are monopoles or dipoles.

16. The antenna system of claim 11, wherein said primary radiating element is a patch antenna and said reconfigurable parasitic elements are radiating strip elements.

17. The antenna system of claim 11, wherein said usage detector is further configured to:

identify a change in one or more of the received signal strength of the beamforming antenna, the directional alignment of the wireless device, the propagation characteristics of a received signal via the beamforming antenna, the input impedance of the beamforming antenna, or any combination thereof.

18. The antenna system of claim 11, wherein the controller is further configured to:

determine to update the beamforming antenna by using a change in one or more of the received signal strength of the beamforming antenna, the directional alignment of the wireless device, the propagation characteristics of a received signal via the beamforming antenna, the input impedance of the beamforming antenna, or any combination thereof.

19. The antenna system of claim 11, wherein the controller is further configured to:

determine to update the beamforming antenna by measuring a plurality of received signal strengths for the beamforming antenna, wherein each measurement corresponds to said primary radiating element with one or more different reconfigurable parasitic elements, and determining one of said plurality of received signal strengths is greater than the received signal strength for the beamforming antenna.

20. The antenna system of claim 11, wherein the primary radiating element is used to provide an omnidirectional antenna-pattern beam.

21. The antenna system of claim 11, wherein said controller operates in real time.

22. An antenna system for a wireless device, comprising:

a beamforming antenna for generating an antenna-pattern beam, said beamforming antenna comprising:

a primary radiating element electrically connected to an adaptive matching network, wherein said adaptive matching network is used for matching the input impedance of said beamforming antenna;

one or more reconfigurable parasitic elements electrically connected, electrically coupled, or both to said primary radiating element and electrically connected to a switching circuit, wherein said switching circuit is used to select one or more of said reconfigurable parasitic elements, and said primary radiating element and said selected parasitic elements cooperatively receive, transmit, or both a radio frequency signal, the parasitic elements to shape and direct the antenna-pattern;

a transceiver electrically connected to said beamforming antenna for transmitting a signal, receiving a signal, or both;

a sensor to detect the directional alignment of the wireless device, the speed of the wireless device, the acceleration of the wireless device, or any combination thereof; and a controller electrically connected to said beamforming antenna, said transceiver, said switching circuit, said adaptive matching network, and said sensor to adapt the antenna-pattern beam of said beamforming antenna, wherein said controller is configured to:

determine that the input impedance of the beamforming antenna using said adaptive matching network is outside a tolerance;

recognize the environment of the wireless device using said beamforming antenna, said transceiver, said switching circuit, said adaptive matching network, said sensor, or any combination thereof;

select a portion of said reconfigurable parasitic elements using the input impedance of the beamforming antenna, an observation table, said recognized environment, or any combination thereof; and update the beamforming antenna by electrically connecting, electrically coupling, or both said selected portion of reconfigurable parasitic elements with said primary radiating element using said switching circuit to adaptively steer the antenna-pattern in a preferred direction.

23. The antenna system of claim 22, wherein said sensor is an accelerometer.

24. The antenna system of claim 22, wherein said sensor is a camera lens.

* * * * *

UNITED STATES PATENT AND TRADEMARK OFFICE

CERTIFICATE OF CORRECTION

PATENT NO. : 8,446,318 B2
APPLICATION NO. : 12/820902
DATED : May 21, 2013
INVENTOR(S) : Shirook Ali and James Warden It is certified that error appears in the above-identified patent and that said Letters Patent is hereby corrected as shown below:

On the Title Page, item [73] should read:

Research in Motion Limited, Waterloo (CA)

Signed and Sealed this
Ninth Day of July, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,446,318 B2
APPLICATION NO. : 12/820902
DATED : May 21, 2013
INVENTOR(S) : Shirook Ali and James Warden It is certified that error appears in the above-identified patent and that said Letters Patent is hereby corrected as shown below:

On the Title Page, item [73] should read:

Research In Motion Limited, Waterloo (CA)

This certificate supersedes the Certificate of Correction issued July 9, 2013.

Signed and Sealed this
Twenty-fourth Day of September, 2013

Teresa Stanek Rea
*Deputy Director of the United States Patent and Trademark Office*